United States Patent [19]

Gebauer et al.

[11] Patent Number: 4,508,349

[45] Date of Patent: Apr. 2, 1985

[54] GOLF CLUB

[76] Inventors: Paul W. Gebauer, 4999 Kahala Ave. #345, Honolulu, Hi. 96816; Smith Choi, 1317 Laukaki St., Honolulu, Hi. 96821

[21] Appl. No.: 552,082

[22] Filed: Nov. 15, 1983

[51] Int. Cl.[3] ..... A63B 53/04

[52] U.S. Cl. ..... 273/175; 273/167 J

[58] Field of Search ..... 273/175, 167 B, 167 C, 273/167 D, 167 J; D21/214

[56] References Cited

U.S. PATENT DOCUMENTS

| | | | |
|---|---|---|---|
| 2,665,909 | 2/1951 | Wilson | 273/175 |
| 3,625,518 | 12/1971 | Solheim | 273/175 |
| 4,367,878 | 1/1983 | Schmidt | 273/175 |

*Primary Examiner*—Richard C. Pinkham
*Assistant Examiner*—Vincent A. Mosconi

[57] ABSTRACT

An improved golf club has a striking face which includes a central portion having an accentuated roll. The roll portion has a radius of curvature preferably between 1 inch and 0.70 inch. Grooves extend parallel to the accentuated roll portion on opposite sides thereof. An upper substantially flat surface extends along the striking face above the upper groove, and a lower substantially flat surface extends along the striking face below the lower groove. These surfaces reduce the effect of a mis-hit. The club face may also have a bulge with a radius of curvature of approximately 4 feet and a loft preferably between 8 and 18 degrees. The increased compression provided by the accentuated roll increases the distance of a drive by approximately ten percent.

8 Claims, 7 Drawing Figures

FIG 1
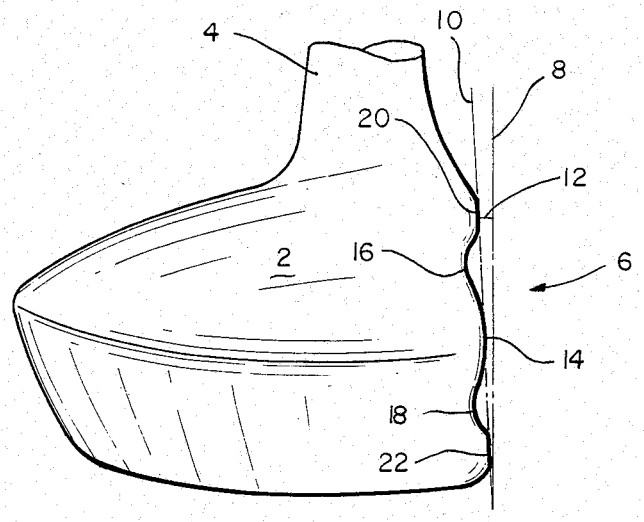
FIG 2
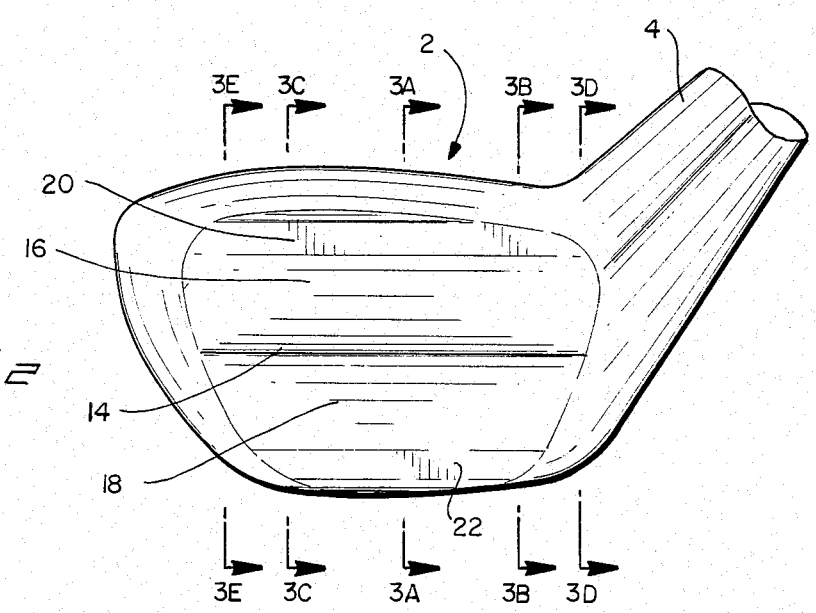
FIG 3B
FIG 3D
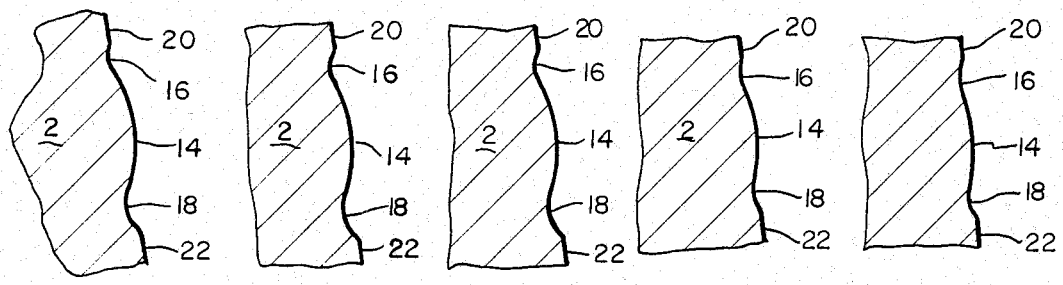
FIG 3A
FIG 3C
FIG 3E

GOLF CLUB

TECHNICAL FIELD

This invention relates to the art of golf clubs.

BACKGROUND ART

A known golf club has a head attached to an elongate shank. When the head is large, the club is known as a "wood", and when the head is plate-like, the club is known as an "iron". It is known to provide a golf club, particularly a "wood", with a curved striking face. This striking face is typically convex about a vertical axis, and convex about a horizontal axis. The horizontal and vertical axes are defined when the club is in the preferred orientation for striking a golf ball.

The curvature about a vertical axis is commonly called "bulge" and is used to reduce the effect of a poor swing by the golfer. The bulge thus reduces the tendency of a ball to hook or slice when the ball is struck with an open or closed club face because of the corrective spin placed on the ball when the face is open or closed.

The roll curvature provides increased compression of the golf ball to obtain greater driving distance.

In addition to roll and bulge, the face of the club may form an angle with the vertical. This angle is called "loft" and is the angle a plane tangent to the striking face forms with a vertical plane. The amount of loft determines the angle of the path of the golf ball with the horizontal.

U.S. Pat. No. 1,299,014 (O'Hara) discloses a golf club having bulge and roll with very large radii of curvature. This patent is primarily directed to the provision of an element which provides additional weight and is located on the back of the club.

U.S. Pat. No. 3,625,518 (Solheim) teaches a golf club wherein the sole of the club is curved upwardly from a central portion to both the heel and toe portions of the club. The club face has roll and bulge about orthogonal axes, wherein the bulge axis is parallel to the axis of the shank of the club.

U.S. Pat. No. 4,367,878 (Schmidt) discloses a golf club wherein the bulge is parabolic.

SUMMARY OF THE INVENTION

The above-described golf clubs do not provide the largest possible distance to a hit golf ball. This is bacause the curvatures employed for the roll on the club face are too small to maximize the distance capability of the club.

In accordance with the invention, a golf club is provided with a face having a roll of large curvature to provide, i.e., a small radius of curvature, to provide maximum compression of a golf ball to thereby achieve maximum distance of a hit golf ball. The roll preferably has a radius of curvature of between one inch and 0.70 inches. This accentuated roll extends from the center of the club face toward the heel and toward the toe. As the accentuated roll portion of the face approaches the heel and the toe, it blends with the peripheral rim of the club face.

At the same time, the club face has bulge for the purpose described above with respect to the prior art.

Surface depressions are provided above and below the accentuated roll portion of the face and are spaced by 0.75 to 0.875 inches. These depressions allow the formation of the accentuated roll portion on a club of normal size and have depths of from 0.1875 to a preferred 0.125 inches in the central portion of the club face. These depths decrease toward the toe and the heel.

Adjacent each groove is an elongated flat surface which reduces the effect of mis-hits by providing a "safety surface."

It is an object of this invention to provide a golf club having a striking face with an accentuated roll.

It is a further object of this invention to provide a golf club having a striking face with bulge and an accentuated roll portion wherein the curvature of the roll decreases from the center of the striking surface toward the heel and the toe portions of the club.

It is yet a further object of this invention to provide a golf club having an accentuated roll portion on the face of the club and grooves extending along the club face above and below the accentuated roll portion.

It is an even further object of this invention to provide a golf club having a striking face with bulge and accentuated roll, wherein parallel grooves extend above and below the roll portion and flat surfaces extend parallel to the grooves at upper and lower portions of the striking face.

BRIEF DESCRIPTION OF THE INVENTION

FIG. 1 is an end view of the head of a golf club according to the invention.

FIG. 2 is a front view of the head of a golf club according to the invention.

FIGS. 3A through 3E are partial cross sections taken along lines 3A through 3E of FIG. 2.

DETAILED DESCRIPTION OF THE INVENTION

An end view of a golf club constructed in accordance with the principles of the invention is shown in FIG. 1. This club is a "driver" or a "wood", which is typically made of wood but which may be made of other materials such as fiberglass or metal. The golf club has a head 2 and a shank 4, and the shank is only partially shown. The club head 2 has a face 6 which is designed to strike a golf ball.

The face of the club has several important features. First, when the golf club is oriented for contacting a golf ball, the face of the club forms an angle with the vertical and this angle is known as "loft." The vertical is represented in FIG. 1 as phantom line 8, and phantom line 10 represents a plane tangent to the central portion of the club face. The angle 12 between the vertical and the club face is the loft angle. This loft is generally between 8 degrees and 18 degrees, but the invention is useful for other angles.

The face 6 of the golf club shown in FIG. 1 is preferably convex in a plane perpendicular to the plane 10. This provides "bulge" for the face of the club to reduce the effect of a mis-hit. The radius of curvature of the bulge may be 10 to 22 inches and in some clubs about four feet.

The face 6 of the invention includes a first accentuated roll portion 14 in the central region of the face 6. Adjacent the roll portion 14 are a first groove 16 located above the roll portion 14 and a second groove 18 located below the roll portion 14. Above the first groove 16 is an upper flat surface 20, and below the second groove 18 is a lower flat surface 22.

The accentuated roll portion 14 has a markedly larger curvature than the roll of a prior art golf club. The prior art club has a radius of curvature of the roll of about 4 feet. In marked contrast to this, the accentuated roll portion 14 of the invention has a radius of curvature preferably between 1 inch and 0.70 inches. A particularly useful curvature in practice has been found to be 0.84 inches.

This large curvature results in a very high compression of the golf ball which in turn results in a very long drive of a golf ball by the golfer. The first and second grooves, 16, 18 allow the accentuated roll portion 14 to be formed into the face of a prior art golf club so that the original bulge and loft of the club are substantially maintained. The grooves 16, 18 extend along the length of the accentuated roll portion and have a separation which depends upon the height of the club head 2. Preferably, the grooves are separated by 0.75 inches to 0.875 inches, and a particularly useful separation has been found to be 0.875 inches. The grooves are from 0.1875 inches to 0.125 inches in depth, with the deepest portion of the grooves being in the central region of the club face. The grooves become shallower at their opposed ends.

The upper and lower flat surfaces 20 and 22 extend substantially along the length of the grooves and are approximately 0.1875 inches wide. These flat strips avoid the exaggerated flight of an off-center hit by engaging the golf ball during such a mis-hit. Thus, a proper hit is when the central part of the accentuated roll portion 14 engages the golf ball. However, if the golfer does not swing properly, the ball engages the roll portion above or below the central part, and in the absence of the flat surfaces 20 and 22, would assume a path extremely deviated from the desired path. With the surfaces 20, 22, the ball engages an off-center part of the roll portion 14 and also engages one of the surfaces 20 or 22. This prevents the ball from assuming the exaggerated path, thus reducing the effect of a mis-hit.

While surfaces 20, 22 are preferably flat or cylindrical if the club face has bulge, it should be understood that it is possible to provide some roll curvature to these surfaces.

FIG. 2 is a front view of the club head 2 showing the striking face 6 and the inventive features thereof. It will be seen that the accentuated roll portion 14 extends substantially along the striking face. Preferably, the roll portion extends an inch or more on either side of the center of the striking face, and in a preferred embodiment, the accentuated roll portion has a length of 2.25 inches. The striking face 6 also has a bulge, and the curvature of the accentuated roll portion 14 thus decreases toward its opposite ends. The depth of the grooves 16, 18, also decreases toward their opposite ends. These features are more clearly shown in FIGS. 3A through 3E.

FIG. 3A represents the central portion of the striking face 6. In this portion, the accentuated roll 14 has the greatest curvature, i.e., the shortest radius of curvature. Also, the depth of the grooves 16 and 18 is largest. As the accentuated roll portion 14 extends outwardly from the central portion, the radius of curvature increases, and the grooves 16 and 18 become shallower. This is shown in FIGS. 3B and 3C. Toward the outer edges of the accentuated roll portion 14, the curvature becomes even larger and the depth of grooves 16 and 18 becomes even smaller, and shown in FIGS. 3C and 3E. The accentuated roll 14, grooves 16, 18, and flat surfaces 20, 22 then merge with the remainder of the club head and this is facilitated by providing a known bulge of the striking face.

Also, as noted above, the striking face is preferably formed from a club head having loft and roll. Thus, the plane 10 which is tangent to the roll 14 at the center of the roll portion may include flat surfaces 20 and 22, or the surfaces 20 and 22 may alternatively be displaced slightly from the tangent plane because of an overall curvature of the striking face 6.

In the preferred embodiment, the accentuated roll portion 14 is a toroidal surface which is substantially horizontal when the club is in an orientation to strike a golf ball. However, it is within the scope of the invention to provide a deviation from the horizontal orientation.

In a test performed for the applicant, the preferred embodiment described above produced unexpectedly long drives in comparison with a known club. The average drive for a club having a striking face in accordance with the invention was 247 yards. In contrast to this, the average drive for a golf club of prior art construction having identical features to that of the invention club except for the construction of the striking face, was 228 yards. This test was conducted by hitting ten golf balls with the prior art club and 11 with the inventive club. When considering only the best five hits, for each club, the average distance for the prior art club was 236 yards while that for the inventive club was 257 yards.

It will thus be seen that an improved golf club has been described wherein a central portion of the club has an accentuated roll. This provides for increased compression of the golf ball resulting in an unexpectedly long drive. The new golf club also includes flat strips above and below the the accentuated roll portion to reduce the effect of a mis-hit.

Modifications within the scope of the claims will be apparent to those of skill in the art.

What is claimed is:

1. A golf club comprising a head having a face for making contact with a golf ball, wherein said face includes a curved surface extending along a central region of said face from a location near the heel in a direction toward the toe of said club, and said fall also includes first and second substantially flat surfaces extending substantially parallel to said direction, said first and second substantially flat surfaces being respectively above and below said curved surface.

2. The golf club of claim 1 wherein said curved surface has a large radius of curvature about a vertical axis and a smaller radius of curvature about a horizontal axis.

3. The golf club of claim 2 wherein said redius of curvature about a horizontal axis decreases from a heel portion of said face to a central portion and then increases toward a toe portion.

4. The golf club of claim 3 wherein said radius of curvature about an horizontal axis in said central portion of said club is less than about one inch.

5. The golf club of claim 4 wherein said radius of curvature about a horizontal axis in the central portion of said club is substantially 0.84 inches.

6. The golf club of claim 4 wherein said first and second substantially flat surface are co-planar.

7. The golf club of claim 4 comprising a first groove between said first flat surface and said curved surface, and a second groove between said curved surface and said second flat surface.

8. The golf club of claim 7 wherein the bottom of each of said grooves is displaced from a plane containing said first and second flat surfaces, in a central region of said face, by approximately 0.125 inches.

* * * * *